US006317905B1

(12) United States Patent
Slothower

(10) Patent No.: US 6,317,905 B1
(45) Date of Patent: Nov. 20, 2001

(54) SPOUT WITH VACUUM BREAKER PROTECTION

(75) Inventor: Erich D. Slothower, Sheboygan, WI (US)

(73) Assignee: Kallista, Inc., Kohler, WI (US)

( * ) Notice: Subject to any disclaimer, the term of this patent is extended or adjusted under 35 U.S.C. 154(b) by 0 days.

(21) Appl. No.: 09/543,915

(22) Filed: Apr. 6, 2000

(51) Int. Cl.[7] ..... E03C 1/10
(52) U.S. Cl. ..... 4/678; 137/217; 137/801
(58) Field of Search ..... 4/671, 675, 678; 137/217, 218, 801

(56) References Cited

U.S. PATENT DOCUMENTS

| | | | | |
|---|---|---|---|---|
| 2,133,804 | | 10/1938 | Brooks | 137/218 |
| 3,056,418 | * | 10/1962 | Adams et al. | 137/217 |
| 3,104,674 | | 9/1963 | Bills et al. | 137/218 |
| 3,796,380 | * | 3/1974 | Johnson et al. | 4/678 X |
| 4,696,322 | | 9/1987 | Knapp et al. | 137/218 |
| 4,757,841 | * | 7/1988 | Lucas | 137/801 |
| 5,063,619 | | 11/1991 | Ross et al. | 137/218 X |
| 5,325,885 | * | 7/1994 | Ivan et al. | 137/217 |
| 5,533,546 | | 7/1996 | Dixon | 137/218 |

* cited by examiner

*Primary Examiner*—Robert M. Fetsuga
(74) *Attorney, Agent, or Firm*—Quarles & Brady LLP

(57) ABSTRACT

Disclosed herein is a plumbing spout that has back flow protection. The spout positions a check valve vacuum breaker underneath the pull up knob in a plug assembly. The spout provides back flow protection even though it has no fluid control valve for controlling flow through to the spout outlet.

5 Claims, 2 Drawing Sheets

FIG. 1
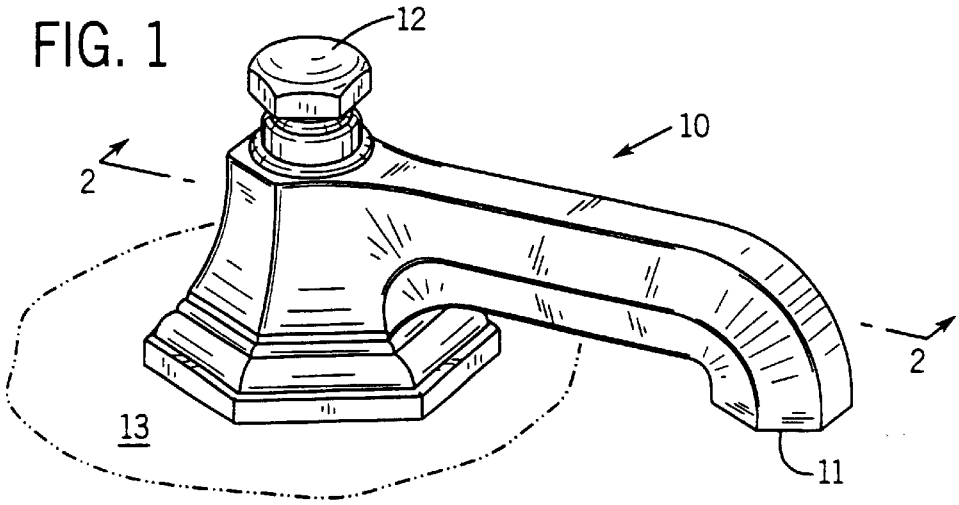
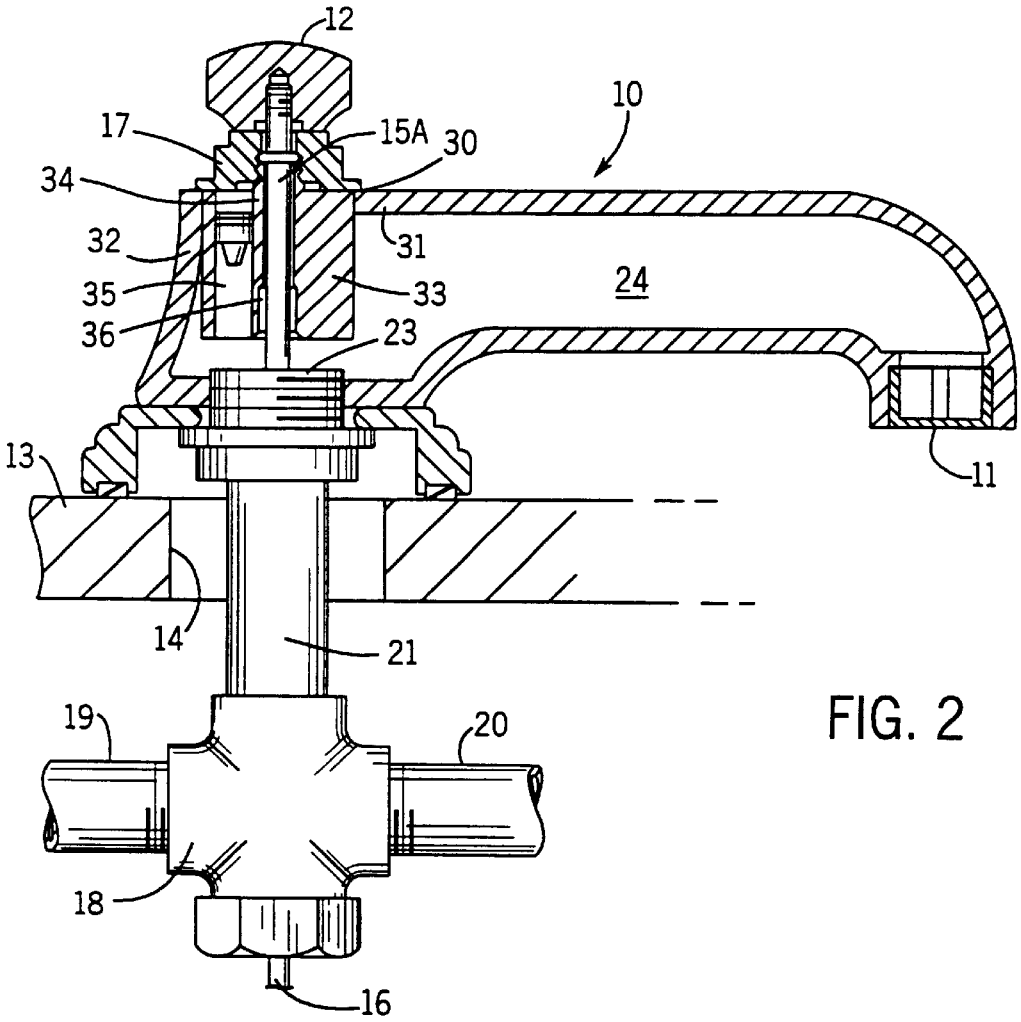
FIG. 2

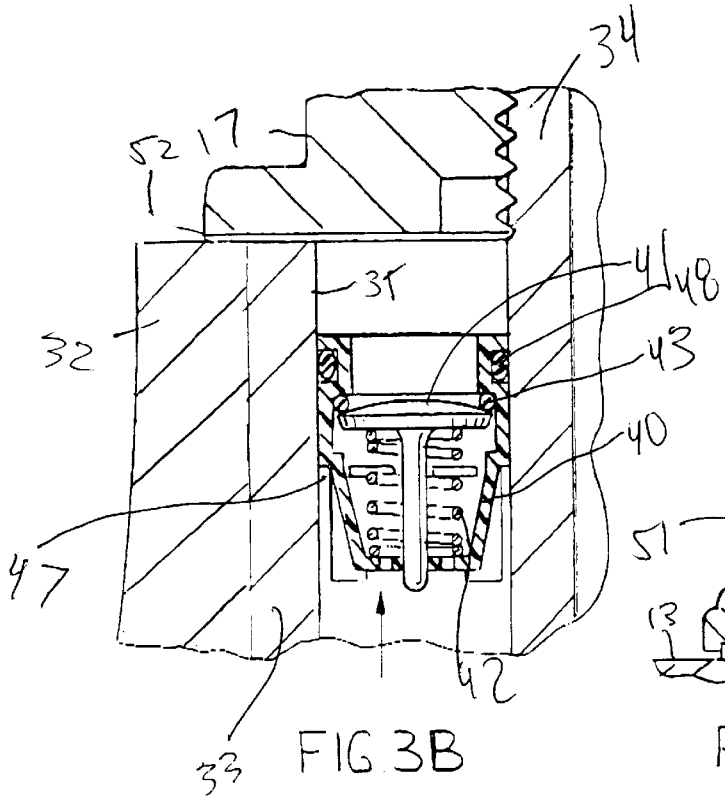
FIG. 3B
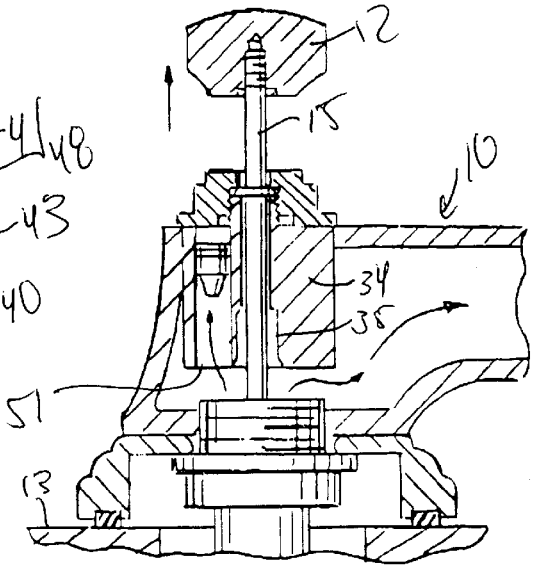
FIG. 3A
FIG. 4B
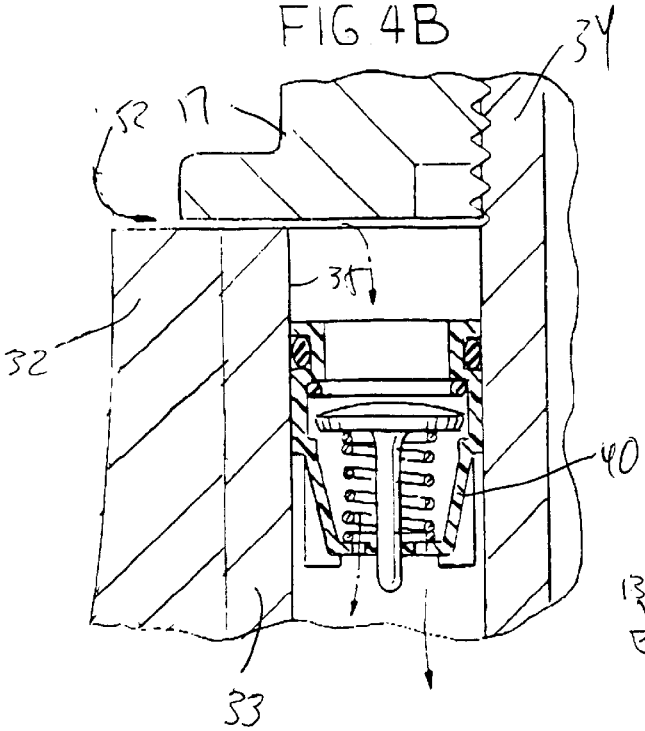
FIG. 4A
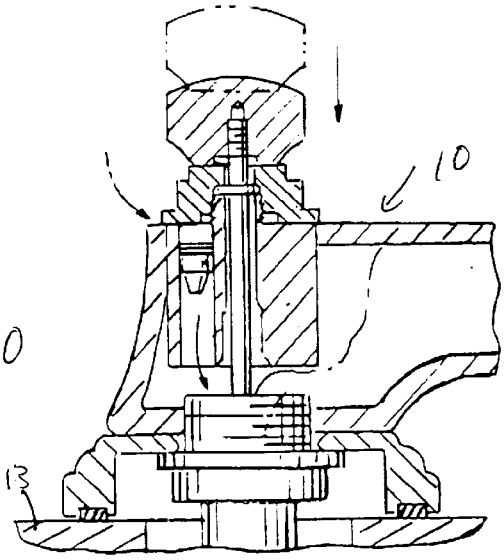

SPOUT WITH VACUUM BREAKER PROTECTION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to spouts that have internal back flow protection.

Plumbing codes typically require back flow protection when a plumbing outlet is likely to be adjacent contaminated water. For example, kitchen spray units of the type which can be pulled out from the sink or a faucet are typically provided with back flow protection. See e.g. U.S. Pat. No. 4,696,322. The disclosure of this patent and of all other publications referred to herein are incorporated by reference as if fully set forth herein.

Back flow protection has also been provided in stop cocks. See U.S. Pat. No. 2,133,804.

Back flow protection can be provided to some extent by including a one-way check valve in the supply line, or preferably (and/or additionally) by providing a means to bleed air into the fitting should upstream negative pressure develop (e.g. a supply line to a high rise apartment breaks). This latter approach significantly offsets any suction which might cause contaminated water to be sucked back into the line, and is known as vacuum breaking.

However, there is another type of faucet where the hot water is controlled by a first stop cock positioned at one location on a sink, the cold water is controlled by a second stop cock positioned at a second separate location on a sink, and outlets from both valves feed to a centrally located spout which has no valving to control water flow. While each such stop cock could be provided with separate vacuum breaker protection (compare U.S. Pat. No. 2,133,804), this requires two separate stop cocks to be modified to provide such protection.

Providing vacuum breaker protection in connection with such spouts is not typical as such spouts are often slanted upward so that their outlets are sufficiently far away from contaminated water below that plumbing codes don't usually require such protection. However, very low profile designs have been developed for such spouts where the outlet is very close to the base of the spout. Some plumbing codes require back flow protection in connection with such spouts.

Complicating matters is the fact that such designs are often provided with a pull up knob that rests on top of the spout. The knob is connected to an extension which projects downwardly through the spout in parallel to the water supply line to link to the drain control mechanism.

Thus, it can be seen that a need exists for back flow protection in such spouts.

BRIEF SUMMARY OF THE INVENTION

The present invention provides a plumbing spout connectible to a supply of a fluid (typically water) in order to deliver the fluid to a selected site (preferably a lavatory or bath tub basin). The spout has a housing having an internal hollow. A lower inlet, upper opening and a side outlet passageway are provided in the housing and are all in communication with the hollow.

There is also a pull up knob having a downward extension that passes through the housing so as to be suitable to be connected to a drain control valve. Further, there is a plug mounted adjacent the upper opening, the plug having a bore which is in communication with atmosphere at its top and is also in communication with the lower inlet.

A check valve is positioned in the plug bore. The valve is normally biased to restrict air from entering the hollow through the bore. However, it permits air to enter the hollow through the bore if negative pressure develops in the hollow.

In preferred aspects the plug extension passes through a second bore in the plug, the check valve is spring biased in an upward direction (and is also urged into the closed position by water when water is supplied to the spout), and the spout does not contain any valve for controlling water flow to the housing outlet. Also, the side outlet passageway can be part of a generally horizontal spout outlet extension. If the pull up knob is removed from the spout the check valve can be accessed through the upper opening.

It will therefore be appreciated that the present invention provides back flow protection for a spout that is not part of a fluid control valve. The check valve itself can be hidden underneath the pull up knob so as to provide a more aesthetically pleasing appearance than would occur if an air access were readily visible. Further, the assembly can be easily manufactured and assembled. Should the check valve require maintenance, it can easily be accessed without removing the spout from its mounting on a plumbing fixture.

The foregoing and other advantages of the invention will appear from the following description. In this description reference is made to the accompanying drawings which form a part hereof and in which there is shown by way of illustration preferred embodiments of the invention. These embodiments do not represent the full scope of the invention. Thus, the claims should be looked to in order to judge the scope of the invention.

BRIEF DESCRIPTION OF THE DRAWINGS

FIG. 1 is a left upper perspective view of a spout in accordance with the present invention;

FIG. 2 is a vertical cross-sectional view, partially not sectioned, taken along line 2—2 of FIG. 1;

FIG. 3A is a detailed sectional view of a portion of FIG. 2, albeit with the pull up knob in the closed position;

FIG. 3B is an enlarged sectional view of another portion of FIG. 2, showing the check valve in the closed position;

FIG. 4A is a view similar to FIG. 3A, but with the pull up knob in the down position and the valve experiencing negative pressure conditions; and FIG. 4B is a view similar to FIG. 3B, but with the check valve in the open position.

DETAILED DESCRIPTION OF THE PREFERRED EMBODIMENTS

Referring first to FIGS. 1 and 2, a spout 10 is provided having a downwardly projecting outlet 11 and pull up knob 12. The spout can be positioned on a counter or plumbing fixture through a hole 14. The pull up knob can have threaded into it a downwardly projecting shaft extension 15 which can be connected via linkage 16 to the usual drain control valving. In an especially preferred form, the extension can be guided through a cylinder sleeve 15A which serves to isolate the extension 15 from the water.

Typically, the drain will be located in a basin under the spout opening 11 (not shown). The pull up knob can rest on decorative escutcheon 17 which has a central top opening to permit the extension 15 to slide therein.

Below the opening 14 is a coupling 18 which receives and mixes water from a hot water supply line 19 and a cold water supply line 20. The volume of water entering each of the supply lines 19 and 20 is controlled by conventional stop cocks (not shown). Water mixes in the coupling 18 and then heads upwardly along supply pipe 21 to feed the spout inlet end 23. It should be appreciated that pull up extensions 15 and 16, and sleeve 15A, are parallel to and outside of supply pipe 21. Water entering inlet 23 will (in the normal course) pass through horizontal outlet pathway 24 via the hollow portion of the spout housing to an outlet 11.

As best seen in FIGS. 3A, 3B, 4A, and 4B, an upper opening 30 is provided in the upper wall 31 of the spout 10, adjacent the rear wall 32. A plug 33 is welded, threaded, or otherwise securely mounted in a leak proof manner in the opening 30. The plug has two vertically extending bores 35 and 36.

Within bore 35 is positioned a check valve cartridge 40. Preferably this is check valve cartridge CO 010 available from Watts Ocean. It has a piston 41 which is biased upwardly by spring 42 against O-ring seal 43 to normally close off flow through the check valve. A slight restriction in bore 35 can form a shoulder 47 to restrict downward movement of the cartridge 40. An external O-ring 48 can be positioned around the cartridge 40 to cause the check valve to resist upward movement due to friction between the O-ring and the walls of bore 35.

During normal water flow conditions, water 51 can pass into the check valve and assist in sealing the bore 35. However, as shown in FIGS. 4A and 4B, during negative pressure conditions water will not be present to assist in the closure, and the spring bias can therefore be easily overcome by the negative air pressure. Air can then bleed into the opening in the inlet 23 through the check valve, thereby relieving the negative pressure. Note that the pathway of air access is via entry 52 which is essentially hidden under the pull up valve.

Should it be desired to service or replace the check valve, this can easily be accomplished by unscrewing the pull up knob, unscrewing the escutcheon from extension 34 from the plug, and accessing the cartridge from the top of bore 35. Further, this mounting system makes it very easy to initially assemble the check valve.

It will be evident from the above description to those skilled in the art that various changes and modifications can be made to the above described system without departing from the scope of the present invention. For example, it is possible for the pull up knob extension to pass outside of the plug. However, the plug preferably serves as an additional guide support for the sleeve 15A. Accordingly, to ascertain the full scope of the invention, reference should be had to the following claims.

INDUSTRIAL APPLICABILITY

The above disclosure provides a plumbing spout with back flow protection.

I claim:

1. A plumbing spout connectible to a supply of a fluid in order to deliver the fluid to a selected site, the spout comprising:

a housing having an internal hollow, wherein a lower inlet, upper opening and a side outlet passageway are provided in the housing and are all in communication with the hollow;

a pull up knob having a downward extension that passes through the housing so as to be suitable to be connected to a drain control valve;

a plug mounted adjacent the upper opening, the plug having a first bore which is in communication with atmosphere at its top and is also in communication with the housing lower inlet; and a check valve positioned in the first plug bore, the valve normally being biased to restrict air from entering the hollow through the first bore, but permitting air to enter the hollow through the first bore if negative pressure develops in the hollow;

wherein the extension passes through a second bore in the plug.

2. The plumbing spout of claim 1, wherein the check valve is spring biased in an upward direction.

3. The plumbing spout of claim 1, wherein the spout does not contain a fluid control valve for controlling water supply to the housing outlet.

4. The plumbing spout of claim 1, wherein the side outlet passageway is in a generally horizontal spout outlet extension.

5. The plumbing spout of claim 1, wherein if the pull up knob is removed from the spout the check valve can be accessed through the upper opening.

* * * * *